US005742221A

United States Patent [19]

Baeg

[11] Patent Number: 5,742,221

[45] Date of Patent: Apr. 21, 1998

[54] ELECTRIC POWER DISCONNECTION APPARATUS FOR MICROWAVE OVEN

[75] Inventor: Yoon Gun Baeg, Kyungsangnam-Do, Rep. of Korea

[73] Assignee: LG Electronics, Inc., Seoul, Rep. of Korea

[21] Appl. No.: 730,232

[22] Filed: Oct. 15, 1996

[30] Foreign Application Priority Data

Oct. 16, 1995 [KR] Rep. of Korea ..... 1995/28973

[51] Int. Cl.[6] ..... H01H 85/143

[52] U.S. Cl. ..... 337/196; 337/227; 337/208; 337/212; 200/293

[58] Field of Search ..... 337/227, 212, 337/211, 208, 213, 228; 439/621, 622, 623, 698, 249, 250, 251, 620; 493/269, 270; 361/271, 272; 29/623; 200/56, 293

[56] References Cited

U.S. PATENT DOCUMENTS 1,896,545 2/1933 Jirka et al. ..... 337/196

5,254,879 10/1993 Jackson ..... 307/116

*Primary Examiner*—Leo P. Picard

*Assistant Examiner*—Anatoly Jortman

*Attorney, Agent, or Firm*—Strolenk, Faber, Gerb & Soffen, LLP

[57] ABSTRACT

An electric power disconnection apparatus for a microwave oven which is capable of simply disconnecting the electric power supply to the system when disassembling an outer casing from a frame of a microwave oven by attaching a fuse holder to the outer casing, which includes an outer casing covering the upper portion and both sides of a frame, a fuse holder having a fuse insertion groove formed in the lower portion of the fuse holder and fixed to the outer casing, with a fuse being detachably inserted into the fuse insertion groove, and a noise filter having a plurality of power terminals formed on the surface thereof and a pair of spaced-apart fuse contact members, with the noise filter serving to prevent a noise generated inside the frame, with the both ends of the fuse electrically contacting with the fuse contact portions of the fuse contact members.

4 Claims, 4 Drawing Sheets

ELECTRIC POWER DISCONNECTION APPARATUS FOR MICROWAVE OVEN

BACKGROUND OF THE INVENTION

1. Field of the Invention

The present invention relates to an electric power disconnection apparatus for a microwave oven, and particularly to an improved electric power disconnection apparatus for a microwave oven which is capable of simply disconnecting an electric power supply to the system when disassembling an outer casing from a frame of a microwave oven by attaching a fuse holder to the outer casing.

2. Description of the Conventional Art

FIG. 1 is a perspective view illustrating the entire construction of a conventional microwave oven, and FIG. 2 is a perspective view illustrating a fuse and a noise filter of a conventional microwave oven.

As shown therein, a frame 1 is disposed for supporting components arranged inside the microwave oven. A plurality of control switches 2 are arranged at one side of the front surface of the frame 1 for controlling various functions of the microwave oven. A cooking chamber 3 is formed inside the frame 1 in which cooking chamber 3 food to be cooked is placed.

A door 4 is attached at the front surface of the frame 1 for opening/closing the cooking chamber 3, and a magnetron 5 is disposed at a portion inside the frame 1 for generating microwaves to the cooking chamber 3.

A power unit 6 is disposed below the magnetron 5 for generating a high current voltage for the magnetron 5.

A noise filter 7 is disposed in an upper portion inside the frame 1 for filtering a noise generated inside the frame 1.

A plurality of power terminals 9 are formed on the upper surface of the noise filter 7 for connecting with a power cable 8 extended to the power unit 6, and a fuse holder 10 having a fuse insertion elastic portion is formed in the upper surface of the noise filter 7 for receiving a fuse 11 into the fuse insertion elastic portion of the fuse holder 10.

An outer casing 12 covers the upper portion and both sides of the frame 1 in order for the components arranged inside the frame 1 to be protected from an externally applied impact, contaminants, or the like.

The operation of the conventional microwave oven will now be explained with reference to the accompanying drawings.

First, the power cable 8 is connected to the power terminals 9 of the noise filter 7, and the fuse 11 is inserted into the fuse insertion elastic portion of the fuse holder 10, and the outer casing 12 is assembled to the frame 1.

When the power cable 8 is supplied with an external voltage, the alternating current is supplied to the power unit 6 through the power terminals 9 of the noise filter 7. When the fuse 11 inserted into the fuse insertion elastic portion of the fuse holder 10 is supplied with a predetermined level of alternating current voltage, the fuse 11 is automatically disconnected, so that the microwave oven can stably operate under a predetermined level of the electric power.

The power unit 6 including a high voltage transformer (not shown), a high voltage condenser (not shown), and a high voltage diode (not shown) serves to generate a high direct current voltage for the operation of the magnetron 5.

The thusly generated high direct current voltage is converted into a high frequency microwave by the magnetron 5, and the polarity of the current voltage is alternately changed, so that the food placed in the cooking chamber 3 is effectively cooked by microwaves.

In accordance with the above-described conventional microwave oven, when disassembling the microwave oven for a repair due to the malfunction of the microwave oven, a user or a repair man may mistakenly apply an electric power to the system in a state that the fuse 11 is electrically inserted into the fuse insertion elastic portion of the fuse holder 10 so as to test whether a predetermined short circuit occurred in the system. In addition, since the power unit 6 is supplied with over 4000 volts, there may occur a dangerous accident to the user or the repair man due to the physical contacts with the high voltage over 4000 volts.

SUMMARY OF THE INVENTION

Accordingly, it is an object of the present invention to provide an electric power disconnection apparatus for a microwave oven which overcomes the problems encountered in the conventional electric power disconnection apparatus for a microwave oven.

It is another object of the present invention to provide an improved electric power disconnection apparatus for a microwave oven which is capable of simply disconnecting the electric power supply to the system when disassembling an outer casing from a frame of a microwave oven by attaching a fuse holder to the outer casing.

To achieve the above objects, there is provided an electric power disconnection apparatus for a microwave oven which includes an outer casing covering the upper portion and both sides of a frame, a fuse holder having a fuse insertion groove formed in the lower portion of the fuse holder and fixed to the outer casing, with a fuse being detachably inserted into the fuse insertion groove, and a noise filter having a plurality of power terminals formed on the surface thereof and a pair of spaced-apart fuse contact members, with the noise filter serving to prevent a noise generated inside the frame, with the both ends of the fuse electrically contacting with the fuse contact portions of the fuse contact members.

Additional advantages, objects and other features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
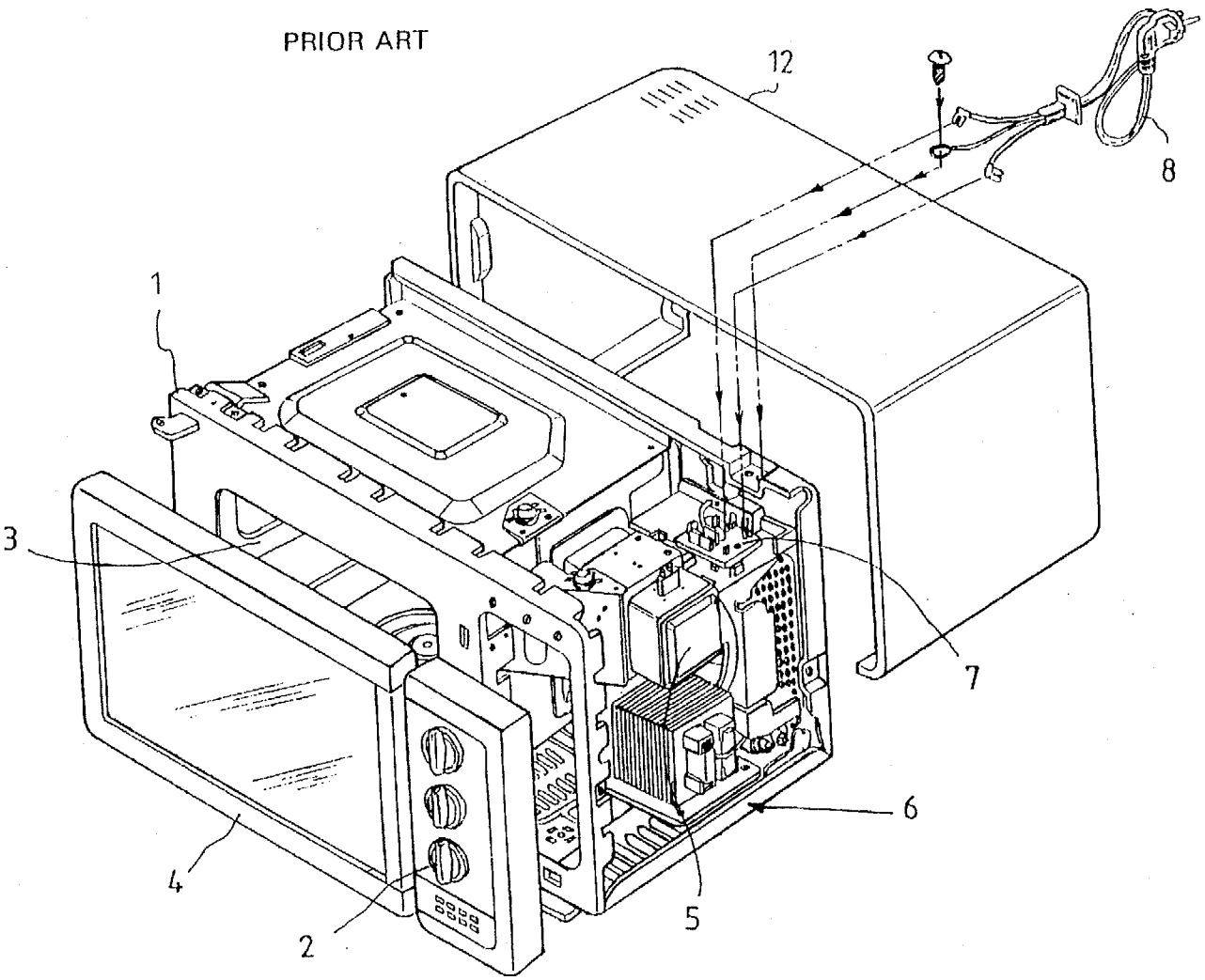
FIG. 1 PRIOR ART
FIG. 1 is a perspective view illustrating the entire construction of a conventional microwave oven.
Figure 2:
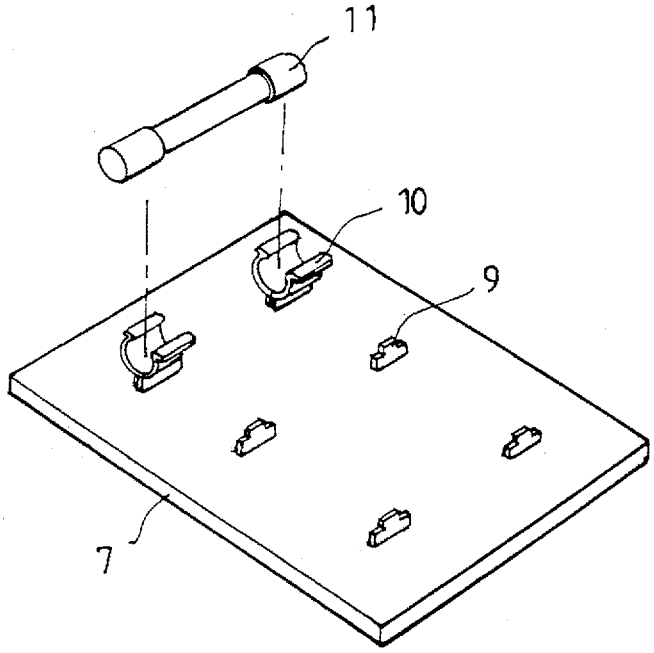
FIG. 2 PRIOR ART
FIG. 2 is a perspective view illustrating a fuse and a noise filter of a conventional microwave oven.
Figure 3:
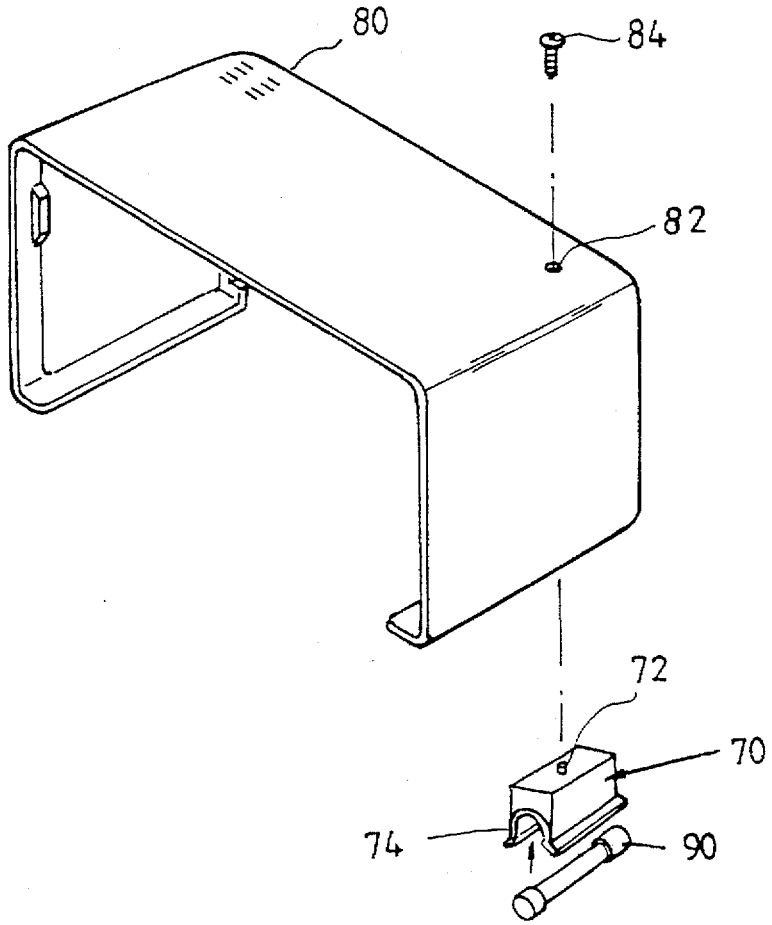
FIG. 3 is a perspective view illustrating an outer casing and a fuse holder attached to a portion of the outer casing of a microwave oven according to the present invention.
Figure 4:
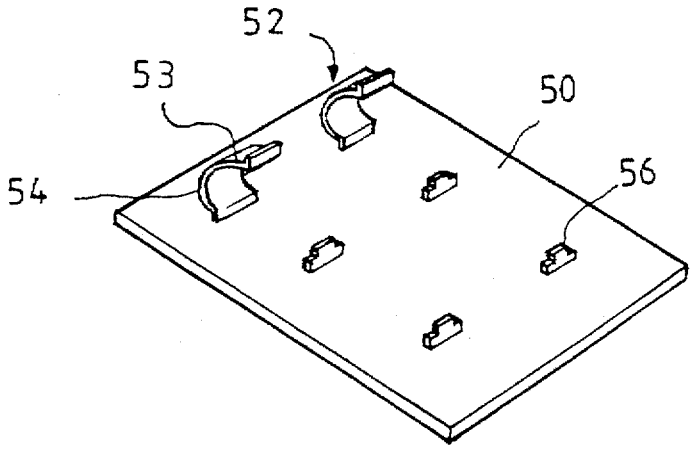
FIG. 4 is a perspective view illustrating a noise filter of an electric power disconnection apparatus according to the present invention.
Figure 5:
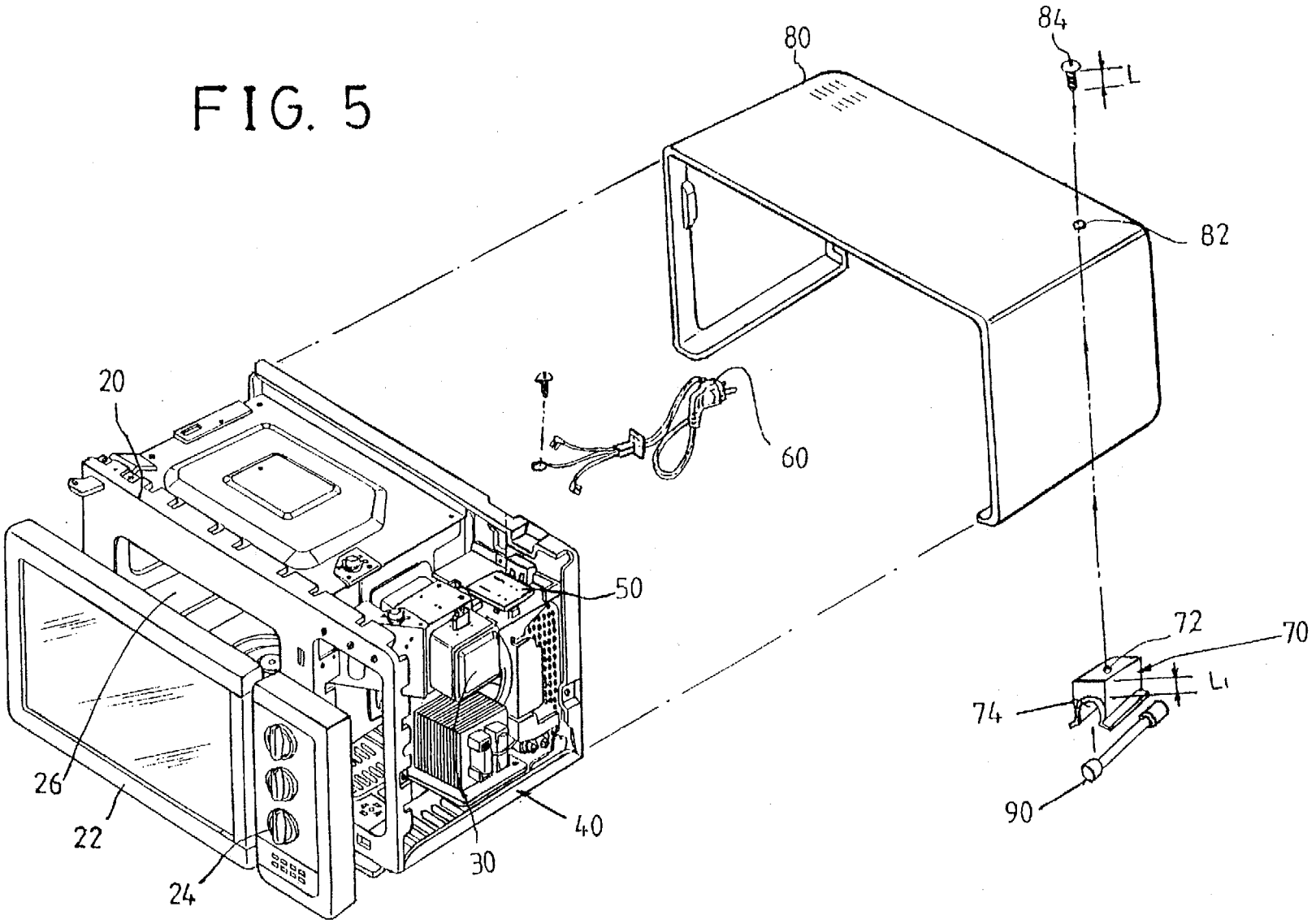
FIG. 5 is a perspective view illustrating a disassembled microwave oven in which an electric power disconnection apparatus is engaged to a microwave oven according to the present invention.

As shown in FIGS. 3 through 5, in the electric power disconnection apparatus according to the present invention, a frame 20 is disposed for supporting the main body of a microwave oven. A door 22 and a control switch 24 are arranged on the front surface of the frame 20, and a cooking chamber 26 is formed inside the frame 20.

A magnetron 30 is disposed inside the frame 20 for generating a high frequency microwave to the cooking chamber 26.

A power unit 40 is disposed below the magnetron 30 for generating a high direct current voltage.

An outer casing 80 is engaged to the frame 20 for covering the upper portion and both sides of the frame 20.

A fuse holder 70 made of an insulation material is fixed at the lower surface of the upper portion of the outer casing 80.

An engaging hole 82 is formed in the upper surface of the outer casing 80.

An engaging hole 72 is formed in the upper surface of the fuse holder 70 mating with the engaging hole 82 when assembling the outer casing 80 to the frame 20, for thus tightly connecting the outer casing 80 and the fuse holder 70 using an engaging screw 84 inserted into the engaging holes 72 and 82, and a fuse holding groove 74 is formed in the lower portion of the fuse holder 70 for receiving a fuse 90 therein.

A noise filter 50 is disposed at a portion inside the frame 20 for filtering the noise which occurs inside the frame 20. In more detail, the noise filter 50 is disposed at a portion where the fuse holder 70 and the noise filter 50 are accurately mated with each other when the outer casing 80 is completely assembled to the frame 20.

A plurality of spaced-apart power terminals 56 are formed on the upper surface of the noise filter 50 for connecting with a power cable 60, shown in FIG. 5, extended to the power unit 40.

A pair of upwardly protruded fuse contact members 52 are formed on the upper surface of the noise filter 50 in order for the both ends of the fuse 90 inserted in the fuse holding groove 74 of the fuse holder 70 to electrically contact with fuse contact portions 53 formed in the top portions of the fuse contact members 52 when the outer casing 80 is completely assembled to the frame 20.

In addition, a semicircular shaped elastic portion 54 is formed at the intermediate portion of each of the fuse contact members 52 for elastically supporting the both ends of the fuse 90 when the outer casing 80 is engaged to the frame 20. Here, the shape of the elastic portion 54 is not limited thereto. Any shape which can implement the same purposes of the elastic portion 54 is possible.

The operation and effects of the electric power disconnection apparatus for a microwave oven according to the present invention will now be explained with reference to the accompanying drawings.

First, the fuse holder 70 is positioned at a predetermined portion of the outer casing 80 in order for the engaging hole 72 of the fuse holder 70 to be mated with the engaging hole 82 of the outer casing 80, and then the fuse holder 70 is fixed to the outer casing 80 using the engaging screw 84.

The power cable 60 may be connected to the power terminal 56 of the noise filter 50 before or after the fuse holder 70 is fixed.

In a state that the fuse 90 is inserted into the fuse holding groove 74 of the fuse holder 70, when the outer casing 80 is completely engaged to the frame 20, both ends of the fuse 90 electrically contact with the fuse contact portions 53 of the fuse contact members 52.

Here, the fuse 90 is elastically supported by the fuse contact portions 53 in cooperation with the elastic portions 54 of the fuse contact members 52.

In the above-mentioned state, when alternating current voltage is supplied to the fuse 90, the power unit 40 generates a high direct current voltage for operating the magnetron 30. The magnetron 30 generates high frequency microwaves to the cooking chamber 26 of the microwave oven.

If a failure occurs in the system, when disassembling the outer casing 80 from the frame 20, since the both ends of the fuse 90 of the fuse holder 70 lose electric contact with the fuse contact portions 53 of the fuse contact members 52, for thus completely disconnecting the power connections from the system.

In the case of testing the system, since the system is always operational in a state that the outer casing 80 is electrically engaged to the frame 20, for thus preventing accident caused due to the high voltage.

As described above, the electric power disconnection apparatus for a microwave oven according to the present invention is directed to enhancing the reliability of the product by supplying electric power to the system only when the outer casing is engaged to the frame.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. An electric power disconnection apparatus for a microwave oven, comprising:

an outer casing covering the upper portion and both sides of a frame;

a fuse holder having a fuse insertion groove formed in a lower portion of the fuse holder and fixed to the outer casing, with a fuse being detachably inserted into the fuse insertion groove; and a noise filter connected to the frame of the microwave oven, having a plurality of power terminals formed on the surface thereof and a pair of spaced-apart fuse contact members, with the noise filter serving to prevent a noise generated inside the frame, with the both ends of the fuse electrically contacting with the fuse contact portions of the fuse contact members.

2. The apparatus of claim 1, wherein said outer casing includes an engaging hole formed at the upper portion of the outer casing.

3. The apparatus of claim 1, wherein each of said fuse contact members of the noise filter includes a contact portion to which the both ends of the fuse electrically contact, and an elastic portion formed at the intermediate portion of the fuse contact members for elastically supporting the fuse.

4. The apparatus of claim 1, wherein said fuse holder includes a second engaging hole formed on the upper portion of the fuse holder matching with the first engaging hole formed on the upper portion of the outer casing, whereby the fuse holder is fixed to the outer casing by inserting an engaging screw through the first and second engaging holes.

* * * * *